United States Patent [19]

Meo

[11] Patent Number: 4,849,607

[45] Date of Patent: Jul. 18, 1989

[54] HEAT GUN ASSEMBLY WITH SCRAPER BLADE CLEANING MEANS AND METHOD

[76] Inventor: Dominick F. Meo, 425 S. Home Ave., Oak Park, Ill. 60302

[21] Appl. No.: 183,090

[22] Filed: Apr. 19, 1988

[51] Int. Cl.[4] ..... H05B 3/00

[52] U.S. Cl. ..... 219/373; 15/246; 219/276; 219/366

[58] Field of Search ..... 15/246; 220/90; 219/271, 273, 276, 366, 373

[56] References Cited

U.S. PATENT DOCUMENTS

| | | | |
|---|---|---|---|
| 3,298,561 | 1/1967 | McCormic | 220/90 |
| 3,492,462 | 1/1970 | Schumacher | 219/373 |
| 3,610,881 | 10/1971 | Stewart | 219/400 |
| 3,975,475 | 8/1976 | Foley | 15/246 |
| 4,275,818 | 6/1981 | Church | 220/90 |
| 4,603,246 | 7/1986 | Costa | 219/366 |
| 4,683,370 | 7/1987 | Peterson et al. | 219/366 |

*Primary Examiner*—A. D. Pellinen
*Assistant Examiner*—Jeffrey A. Gaffin
*Attorney, Agent, or Firm*—Tilton, Fallon, Lungmus & Chestnut

[57] ABSTRACT

A heat gun assembly for using in stripping paint from walls wherein the gun barrel provides a stabilized scraper blade cleaning means.

11 Claims, 1 Drawing Sheet

FIG. 1
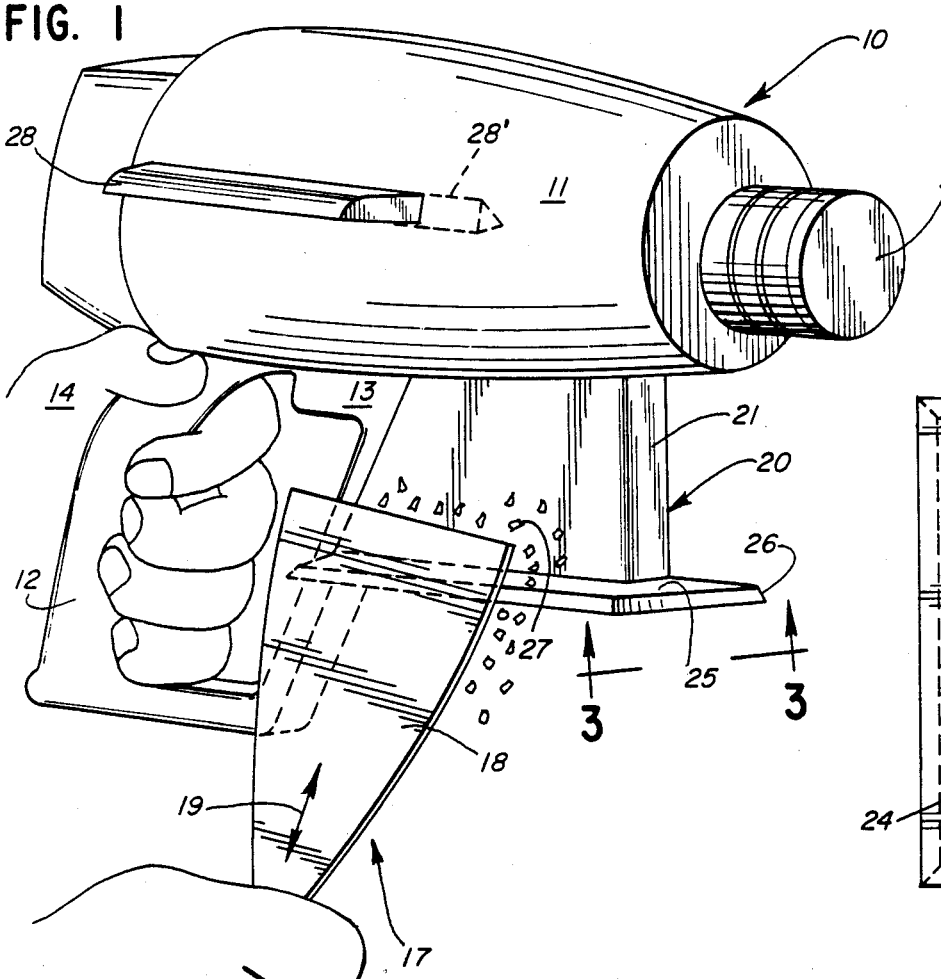
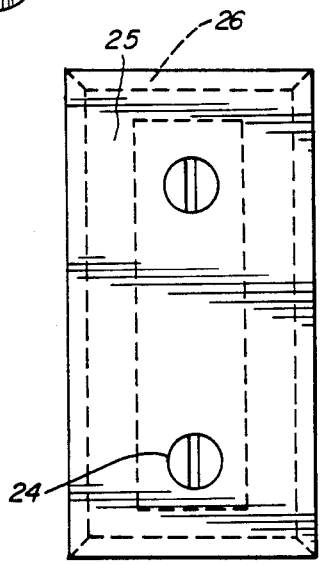
FIG. 3
FIG. 2
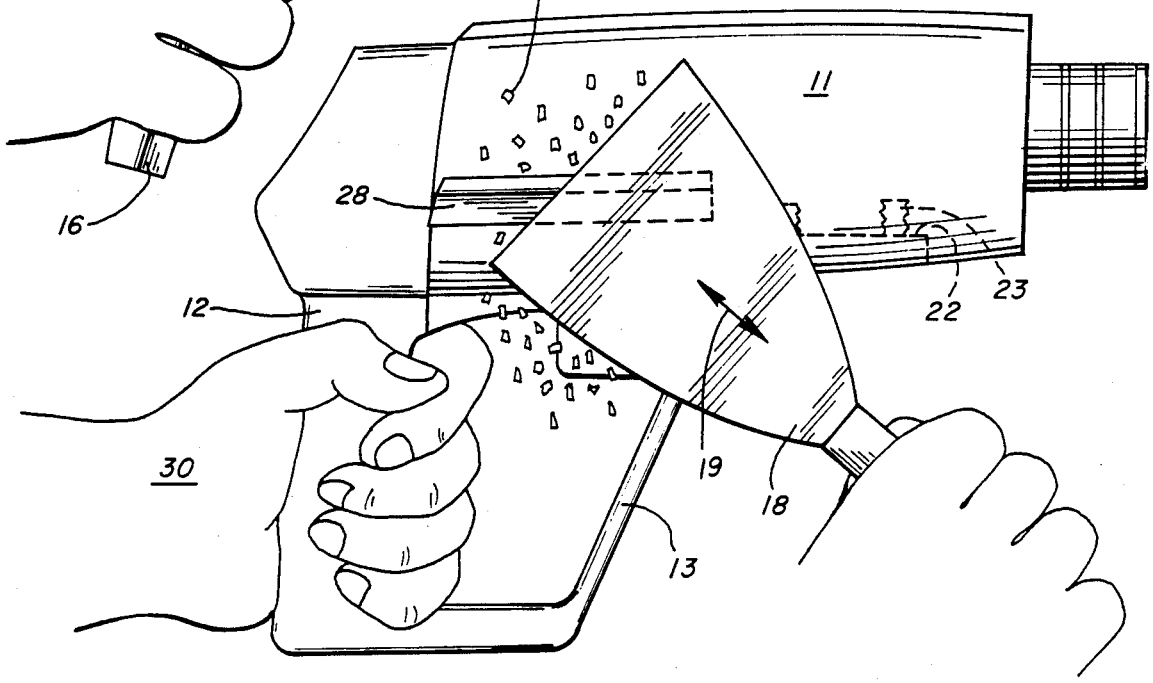

HEAT GUN ASSEMBLY WITH SCRAPER BLADE CLEANING MEANS AND METHOD

BACKGROUND AND SUMMARY OF INVENTION

This invention relates to a heat gun assembly equipped with a scraper blade cleaning means and the method of operation thereof, and more particularly, to a unique heat gun assembly advantageously employable in the stripping of paint from walls and the like—and where the gun itself provides a stabilized platform for cleaning the scraper blade.

In the past, there has always been difficulty in removing the softened paint particles from the scraper blade so as to continue the paint stripping work uninterrupted and unimpeded. Often, persons doing paint stripping would attempt to clean the blade by moving it against their clothes, against a ladder and sometimes even against the gun itself. None of these expedients have been satisfactory, particularly attempting to use the gun as a cleaning means because of the inevitable fouling of the gun surface and possibly even interference with the gun operation.

According to the invention, a blade cleaning means is provided for rigid attachment to the gun barrel. The function is to provide a safe, convenient and efficient place for the user of the gun to clean the tool he or she is using to remove or scrape the paint/varnish. The attachment blades which are plate-like can be cleaned for continued use or the blades can be removed and replaced. The blade cleaning means in the form of an attachment blade or plate is rigidly affixed to the barrel of the heat gun and projects laterally therefrom to provide a knife-like or beveled edge for quick and advantageous cleaning.

Other objects an advantages of the invention may be seen in the details of the ensuing specification.

The invention is described in conjunction with the accompanying drawing, in which—

FIG. 1 is a fragmentary perspective view of a person holding the inventive heat gun assembly in one hand and shown cleaning the blade of a scraper using the other hand;

FIG. 2 is a fragmentary side elevational view similar to FIG. 1 but wherein the gun is equipped only with the upper blade cleaning means; and FIG. 3 is a bottom plan view such as would be seen along the sight line 3—3 of FIG. 1.

DETAILED DESCRIPTION

In the illustration given and with reference first to FIG. 1, the numeral 10 designates generally the inventive heat gun assembly and is seen to include a relatively elongated barrel 11 and depending therefrom the usual pistol grip 12 having a hand guard 13—see also FIG. 2.

In the illustration given, the person doing the paint stripping is right handed and therefore the person's left hand 14 is grasping the pistol grip 12 while the right hand 15 is grasping the handle 16 of a scraper generally designated 17. The scraper 17 is equipped with the usual generally triangular shaped blade 18 and is seen to be moving in a generally vertical reciprocating movement designated by the double ended arrow 19 against a blade cleaning means generally designated 20.

DEPENDING BLADE SCRAPING MEANS

Still referring to FIG. 1, the blade scraping means designated generally 20 is seen to include a depending generally rectangular bracket 21 which is removably affixed to the bottom of the barrel 11—see the right hand portion of FIG. 2 wherein the barrel 11 is equipped with a recess 22 for accommodating the bracket 21 and a pair of threaded openings 23 which are adapted to receive bolts 24 (see FIG. 3).

The bolts 24 are also employed, in the illustration given, to rigidly mount a generally rectangular plate 25 to the bracket 21. The plate 25 is advantageously equipped with parametric beveled edges at 26 to facilitate the cleaning of the scraper blade 18. The plate 25 is disposed generally horizontally when the heat gun assembly 10 is employed to heat paint or varnish on a vertical wall. More particularly, the bracket 21 is positioned forwardly of the pistol grip 12 (and the guard 13) and is generally co-planar therewith. Thus, the plate 25 is disposed generally perpendicularly to the plane of the bracket 21 and the pistol grip 12.

In operation, the scraper 17 is grasped by the hand 15 and reciprocated as indicated at 19 so as to remove softened paint particles 27. It will be noted that the particles are free to fall clear of the hands of the user so that fouling of the hands and gun is advantageously avoided.

LATERALLY EXTENDING BLADE CLEANING MEANS

Reference is now made to FIG. 2 which illustrates the use of the upper blade cleaning means which project laterally from the sides of the barrel 11. As seen in FIG. 1, there are blades 28 and 28' provided on opposite side of the barrel 11 so that the gun assembly is useful for either a right handed or left handed person. Each of the cleaning means 28, 28' is again a plate-like member which is removably mounted in suitable recesses in the sides of the gun barrel 11. Again, cleaning is achieved by a reciprocating motion illustrated at 28 in FIG. 2 and again it will be seen that the particles 29 fall free both of the gun and of the holder's hand 30. The members 28, 28' are positioned on the barrel advantageously slightly forward of the pistol grip 12 so that again the particles fall in a fouless manner.

A significant advantage is that by using the attachment, the operator can move the gun over a trash container while cleaning the scraper blade. This saves much cleaning when the day's work is done.

Summarizing, the invention provides two scraper aid attachment blades which are constructed to be attached to a heat gun for use during the process of removing paint/varnish, etc. Either or both of the blade cleaning means 20, 28, 28' can be employed. Their function is to provide a safe, convenient and efficient place for the use of a heat gun to clean the tool. Both cleaning means versions can be cleaned for continued use or the blades can be removed for separate cleaning and disposal/replacement. The upper cleaning means attachment 28, 28' is located on both sides of the barrel of the heat gun and the body of the blade can be molded as part of the gun or the attachment can be made separately of metal and attached to the barrel when in use. The upper cleaning means in the illustrated imbodiment is approximately 3-½" long and projects approximately ½" laterally of the barrel 11. Each has a bevel of about ⅜".

The lower blade attachment 20 is located on the underside of the gun barrel between the handle and nozzle 31 of the gun. The lower attachment cleaning means 20 is made up of the bracket 21 and the plate 25. The attachment is secured to the barrel 21 with screws or bolts 24 which travel through the blade 25 bracket 21 into the housing 22 and the threaded openings 23. In the illustration given, the plate 25 is 3-⅜" long, i.e., in the direction of the barrel 11 and 2-⅛" wide with ⅛" beveling around the perimeter.

It will be noted that the lower attachment consisting of the plate 25 can be removed by reversing the process by simply unscrewing it but the blade itself can be cleaned while screwed to the gun, removed for cleaning/sharpening or discarded and replaced with a new one.

The bracket 21 of the lower attachment 20 can be part of the mold used during the making of the barrel 11 itself or if desired can be made separately and of a different material. Advantageously, the blade of the lower attachment is constructed of a metal product that can be cleaned and sharpened such as stainless steel.

While in the foregoing specification, a detailed description of the invention has been set down for the purpose of illustration, many variations in the details hereingiven may be made by those skilled in the art without departing from the spirit and scope of the invention.

I claim:

1. A novel heat gun assembly for stripping paint comprising a heat gun having a relatively elongated barrel and pistol grip and blade-shaped scraper cleaning means rigidly fixed to said barrel and providing a linear edge spaced from said barrel for removal of paint from a scraper held in one hand of a user for stripping paint from a surface heated by said gun when the same is held in the other hand of the user.

2. The assembly of claim 1 in which said blade cleaning means is removably fixed to said barrel.

3. The assembly of claim 2 in which said blade cleaning means includes a bracket mounted on said barrel forward of said pistol grip and generally co-planar therewith, and a generally rectangular plate mounted on the lower end of said bracket and extending in a plane generally perpendicular to said pistol grip and bracket.

4. The assembly of claim 3 in which said plate is equipped with beveled edges at least along the sides thereof parallel with the length of said barrel.

5. The assembly of claim 4 in which said plate is removably mounted on said bracket.

6. The assembly of claim 1 in which said blade cleaning means is affixed to the side of said barrel and projects laterally therefrom.

7. The assembly of claim 6 in which said blade cleaning means includes a pair of plate-like members each equipped with a beveled projecting edge and disposed on opposite sides of said barrel.

8. The assembly of claim 7 in which said plate-like members are positioned slightly forwardly of said pistol grip.

9. In a method of stripping paint, the steps of employing a heat gun assembly having a relatively elongated barrel and a pistol grip at one barrel end, said barrel being equipped with blade cleaning means, and simultaneously while gripping said gun with one hand to provide a stable cleaning means, manipulating a handle-equipped scraper with the other hand to engage said blade cleaning means to remove paint particles from said scraper.

10. The method of claim 9 in which said blade cleaning means is rigidly fixed to said barrel and presents a beveled edge laterally spaced from said barrel for engagement with said scraper.

11. The method of claim 9 in which a pair of beveled edges are provided on said blade cleaning means on opposite sides of said barrel whereby said assembly is useful for either right or left handed operation.

* * * * *